United States Patent [19]

Payne

[11] 4,335,832

[45] Jun. 22, 1982

[54] CROSS LINK MECHANISM FOR STAGGERED STACK VENDING MACHINE

[75] Inventor: Harry R. Payne, Chattanooga, Tenn.

[73] Assignee: Cavalier Corporation, Chattanooga, Tenn.

[21] Appl. No.: 151,850

[22] Filed: May 21, 1980

[51] Int. Cl.[3] ..... G07F 11/08

[52] U.S. Cl. ..... 221/67; 221/114

[58] Field of Search ..... 221/67, 114, 115, 116, 221/118

[56] References Cited

U.S. PATENT DOCUMENTS

| | | | |
|---|---|---|---|
| 3,300,084 | 1/1967 | Payne | 221/67 X |
| 3,799,393 | 3/1974 | Baxendale | 221/67 |
| 3,924,779 | 12/1975 | Lindsey | 221/67 |
| 4,220,235 | 9/1980 | Lindsey et al. | 194/10 |

*Primary Examiner*—F. J. Bartuska

*Attorney, Agent, or Firm*—Kerkam, Stowell, Kondracki & Clarke

[57] ABSTRACT

An apparatus for dispensing articles such as cans from adjacent staggered stacks thereof in a bin with the adjacent stacks having two corresponding columns of cans, a releasable support member for each column movable from an article support to an article release position, a linkage for dictating movement of both support members, a pivotally mounted latch plate for controlling movement of both support members and adapted to be disposed from a rest position to either a first position wherein the first support member is maintained in its article support position while the second support member is directed via the linkage to its article release position or a second position wherein the second support member is maintained in its article support position while the first support member is directed via the linkage to its article release position, an escrow bar rigidly secured to the latch plate and movable therewith whereby with the latch plate disposed in either its first or second position and the corresponding support member in its article release position an article is released from each stack with one article dispensed immediately while the other article is retained by the escrow bar.

1 Claim, 10 Drawing Figures

CROSS LINK MECHANISM FOR STAGGERED STACK VENDING MACHINE

BACKGROUND OF THE INVENTION

1. Field of the Invention

This invention relates to an apparatus for dispensing an article from a plurality of articles arranged in front-to-back staggered stacks and in particular to a mechanism for dispensing a single article at a time from front-to-back staggered stacks of articles in which the weight of the articles in the staggered stacks and positive drive means actuates the releasing and dispensing mechanisms, whereas electrically energized means actuates release of the releasing and dispensing mechanisms.

More particularly, this invention relates to a mechanism for dispensing one at a time and in sequence a single article, such as a can or bottle, hereinafter referred to for convenience as a can, from a plurality of cans arranged in front-to-back staggered stacks in which the weight of the cans in the staggered stacks and positive drive means actuates the releasing and dispensing mechanisms and electrically energized means actuates release of the dispensing mechanism. The energized means is energized from any suitable source and controlled by any suitable switch mechanism, preferably one actuated by deposit of a coin.

Even more particularly, this invention relates to a dispensing mechanism in which two staggered stacks of cans are arranged in front-to-back relationship having a releasing mechanism common to both stacks, for releasing, upon energization, a can from each stack with one can dispensed immediately and the other can retained until the mechanism is energized a second time.

2. Description of the Prior Art

Presently, articles such as cans or bottles are stored for selective sale in refrigerated cabinets having coin actuated release mechanisms for dispensing a single can at a time. Many cabinets employ a dispensing apparatus having two adjacent, i.e., front-to-back, staggered stacks with the adjacent stacks having two corresponding columns of cans and with corresponding cans in the adjacent stacks being substantially axially aligned of each other, and a mechanism, common to both columns, for dispensing a single can at a time.

Present dispensing apparatus comprise a reservoir or bin for receiving at least two staggered stacks of cans and releasable support means in the form of first and second support members, one for each column of the adjacent staggered stacks, and movable from an article support to an article release position. Their movement is controlled by a pivotal latch plate disposable from a first position to either a second position wherein the first support member is maintained in its article support position while the second support member is released for movement to its article release position, or a third position wherein the second support member is maintained in its article support position while the first support member is released for movement to its article release position. A first cycle of operation is commenced by closing or energizing a control circuit, which activates a motor initiating rotation of a cam coupled to it. The cam's rotation initially activates a first lock means which controls movement of the latch plate from its first to either of its second or third positions. As the cam continues to rotate, it engages a reciprocally mounted operating plate and moves the operating plate from a first to a second position. As the operating plate moves towards its second position, it engages one of the two support members causing the one support member to follow its movement until disposed in its article release position wherein two cans are released from one of the two columns with one can dispensed directly to the operator, while the other can is retained by an escrow bar. Subsequently, the cam engages a switch which opens or de-energizes the control circuit, thereby de-energizing the cam driving motor.

The second cycle is commenced by reclosing the control circuit, thereby re-energizing the motor to rotate the coupled cam. The cam engages a second lock mechanism, located on the operating plate, and releases for pivotal movement to its article release position the bin mounted escrow bar. When the escrow bar is in its article release position, the retained can is dispensed. Thereafter, the cam engages a switch to open the control circuit and de-energize the cam driving motor.

SUMMARY OF THE INVENTION

It is an object of this invention to provide an article dispensing apparatus that employs a single lock mechanism.

It is a further object of this invention to provide an article dispensing apparatus that employs a lock mechanism for positively controlling movement of both the latch plate and the escrow bar.

It is still another object of this invention to provide an inexpensive and easily serviceable article dispensing apparatus.

These and other objects of this invention are accomplished by providing an apparatus for dispensing a single article or can at a time sequentially from at least two adjacent staggered stacks of cans in a bin with the adjacent stacks having two corresponding columns of cans and with corresponding cans in the adjacent stacks being substantially axially aligned of each other, and releasable support means, in the form of first and second members one for each column of the staggered stacks, movable from an article support to an article release position. Movement of the first and second support members is dictated by a linkage means comprising a vertical link having a first end pivotally secured to a cross link at its centermost portion, a first support link pivotally secured to both one end of the cross link and the first support member, and a second support link pivotally secured to both the other end of the cross link and to the second support member. The movement of both support members to their article release position is controlled by a pivotally mounted latch plate, disposed from a rest position to either a first position wherein the first support member is maintained in its article support position while the second support member is directed via the linkage means to its article release position, or a second position wherein the second support member is maintained in its article support position while the first support member is directed via the linkage means to its article release position. With the latch plate disposed in either its first or second position and the corresponding support member in its article release position, a can is released from each stack. One can is dispensed, while the other is retained by an escrow bar rigidly secured to the latch plate. Each cycle of the two cycle operation of this apparatus is initiated by energizing, via closing a switch, a control circuit, which activates a motor for rotating an engageable cam having a secured stem rotatable therewith. The stem has an arm with a pin thereon, with the arm engaging a lock means for movement from its locked position wherein it engages the latch plate in its rest position, to its unlocked position wherein the latch plate moves freely to either of its first or second position, while the pin engages the second end of the vertical link thereby directing movement of the linkage means. Immediately preceding initiation of the first cycle of operation, the stem is rotatably positioned so that the arm and engaged vertical link are in their uppermost position and the lock means is in unlocked position. As the stem rotates, the pin forces the vertical link downward moving one of the support members towards its article release position, whereupon, the lock means enters its locked position wherein the latch plate with secured escrow bar is retained in rest position and one can from each stack is released. The front stack can is dispensed, while the rear stack can is retained by the locked escrow bar and a side wall of the bin. Thereafter the control circuit is de-energized and the first cycle is completed. Re-energizing the control circuit commences the second cycle of operation. The stem's continued rotation results in the lock means entering its unlocked position where the latch plate and escrow bar are permitted to pivot so as to release the retained can. Thereafter, the control circuit is again de-energized and the second cycle is completed.

The above described apparatus may be modified so that relatively large articles, such as bottles, are dispensed in a one cycle operation. In particular, the bin is modified to receive a single staggered stack via the use of spacers, the escrow bar is removed, and the can is modified to have a single cutout so that it energizes the control circuit only once eliminating the second cycle of operation.

DESCRIPTION OF THE PREFERRED EMBODIMENTS

Figure 1:
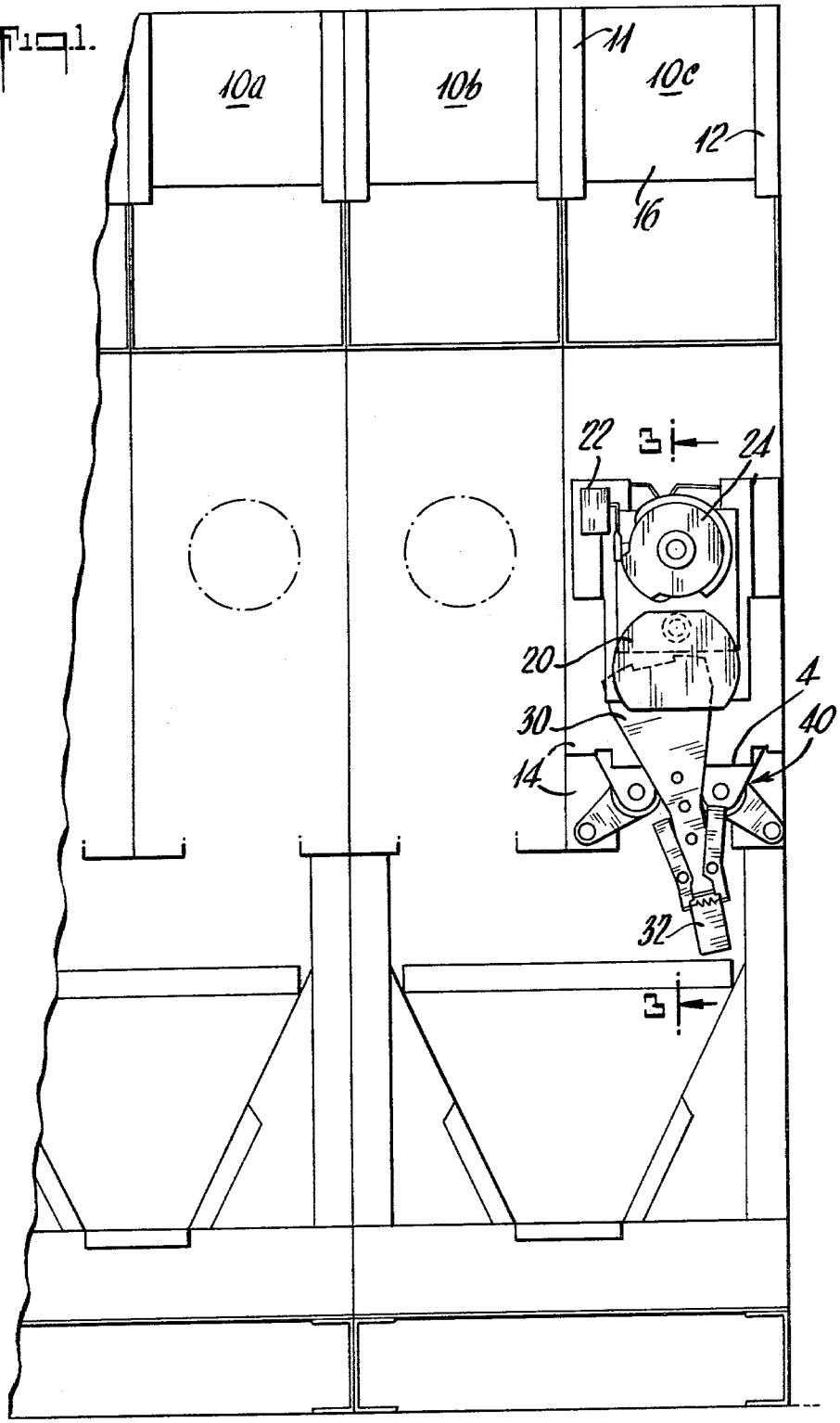
FIG. 1 is a front view of the present invention showing a plurality of bins for receiving cans with one bin showing its corresponding motor and dispensing mechanism.

Referring to the drawings and more particularly to FIG. 1, an article dispensing apparatus having a plurality of bins generally represented by reference numerals 10*a*, 10*b* and 10*c* are shown. For convenience only bin 10*c*, representative of the plurality of bins, is shown in detail. Bin 10*c* is formed by side walls 11 and 12, front wall 14 and rear wall 16, with the side walls spaced apart to receive cans in known staggered stacking, and the rear and front walls spaced apart to receive two adjacent staggered stacks of cans with corresponding cans of each stack axially aligned of one another. Bin 10*c* has an associated dispensing mechanism comprising selectively energizable motor 20 electrically connected to switch 22 for rotating cam 24 when the switch and cam contact, linkage means generally represented by reference numeral 40, a lock means, and pivotally mounted latch plate 30 with rigidly secured escrow bar 32.

Figure 2:
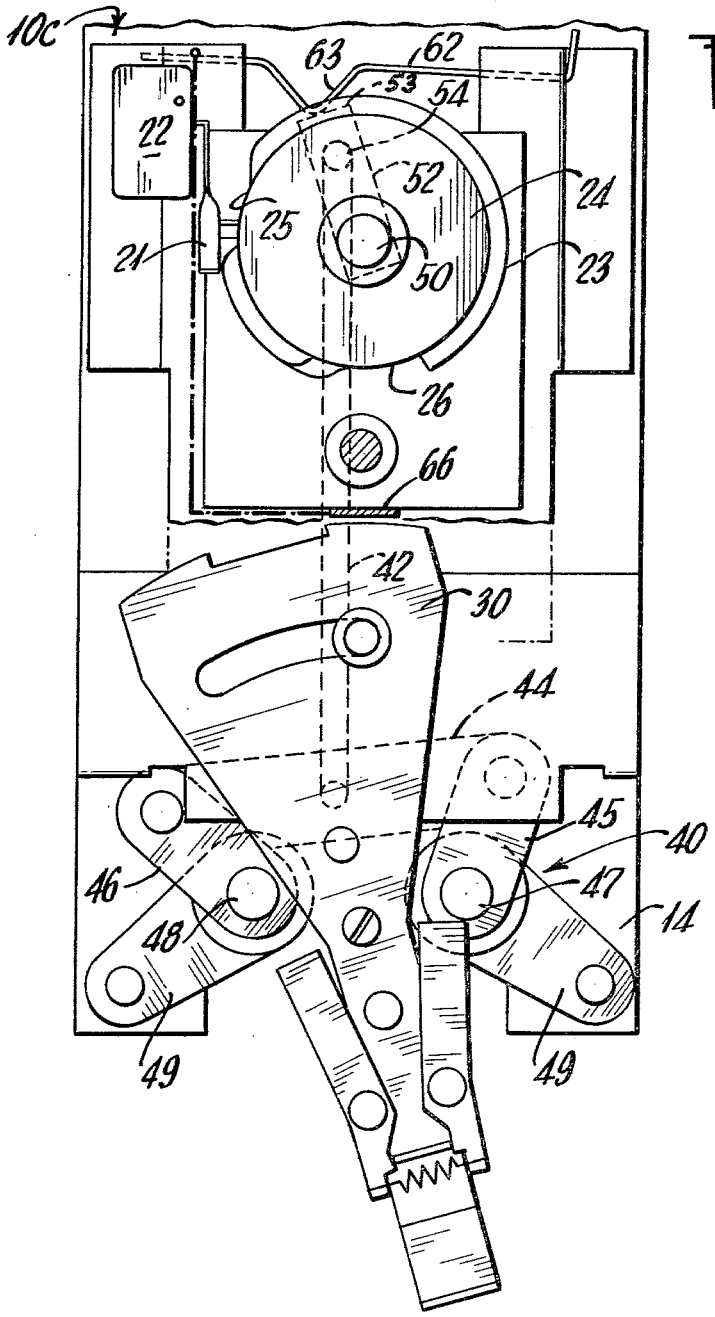
FIG. 2 is an enlarged, front view of the dispensing mechanism shown in FIG. 1, with the motor removed.
Figure 6:
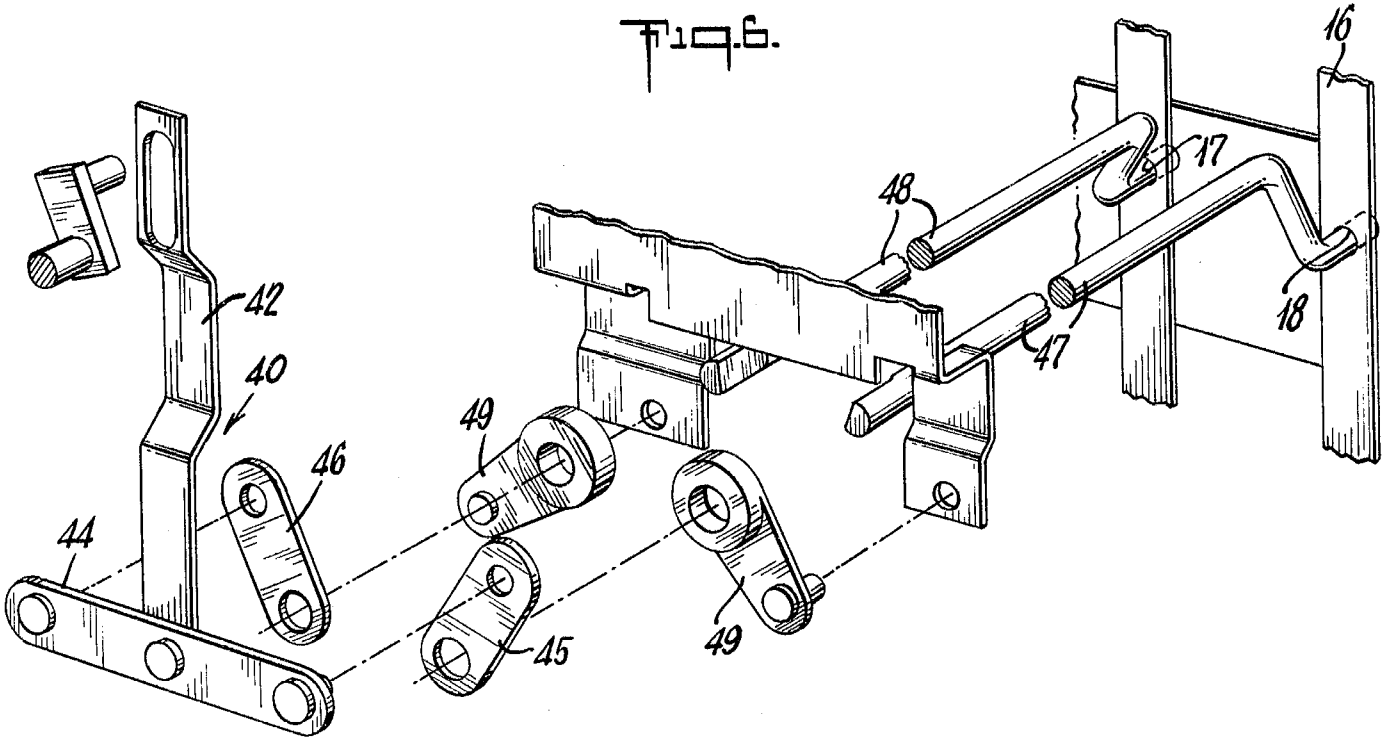
FIG. 6 is an exploded perspective view of the linkage means of FIG. 1.

As shown in FIGS. 2 and 6, linkage means 40 includes vertical link 42 pivotally connected at its lower or first end to the centermost portion of cross link 44, with the cross link having one end pivotally connected to first support link 45 and the other end pivotally connected to second support link 46. First support link 45 is also pivotally connected to first support member 47, likewise, second support link 46 is also pivotally connected to second support member 48. A pair of limiting members 49 are pivotally secured to front wall 14 with each one of the pair pivotally secured to a separate one of the support members 47, 48. The first and second support links and the pair of limiting members are substantially oblong in shape and smaller in length than the elongated U-shaped vertical link and the elongated cross link. The first and second support members are of an elongated stepped configuration. As shown in FIG. 2, cam 24 includes surface 23 having a pair of surface cutouts 25 and 26 therein sized to interrupt the contact between surface 23 and the contacts of arm 21 of switch 22, which results in motor 20 and the control circuit becoming de-energized. Stem 50 is secured to cam 24 and rotatable therewith.

Figure 3:
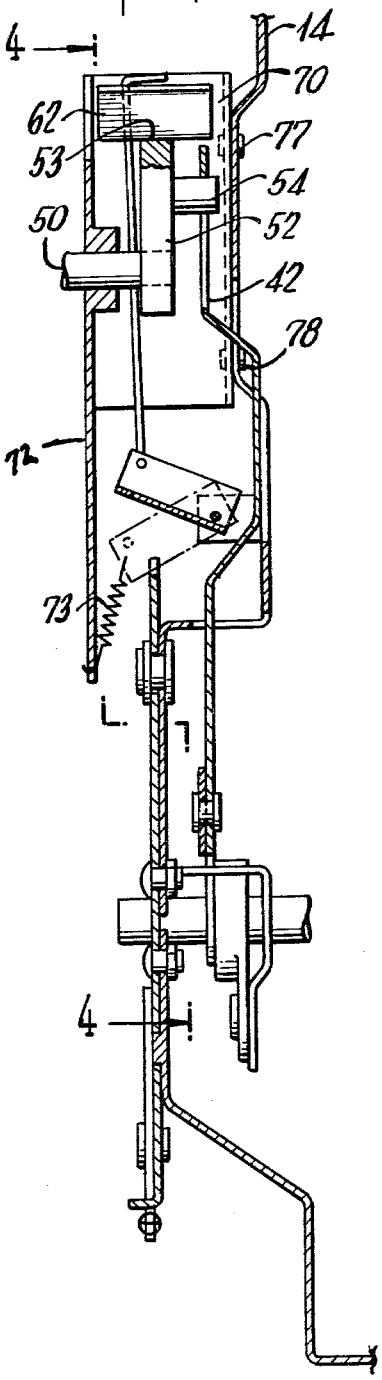
FIG. 3 is a partial side view in section of the dispensing mechanism of FIG. 2 with the cam and switch removed.

As shown in FIG. 3, stem 50, having integral rectangular arm 52 with edge surface 53 and pin 54 thereon, is journaled for support in wall 72 of rectangular plate 70, which is secured to front wall 14 by two pairs of fasteners 77 and 78 (only one of each pair is shown). Pin 54 engages a slot in the upper or second end of vertical link 42. Arm 52 is adapted to engage hinged plate 62. For each rotation of the stem, the pin causes the vertical link to move up and down once, and the arm engages the hinged plate once.

Figure 4:
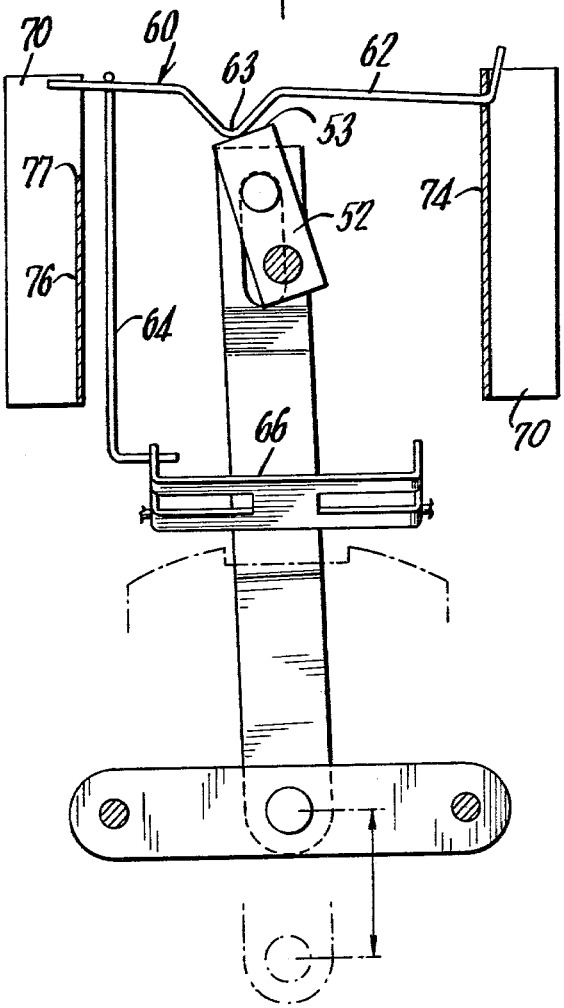
FIG. 4 is a front view in section of the lock means of FIG. 3 taken along line 4—4 thereof.

Referring to FIG. 4, lock means, generally represented by reference numeral 60, comprises hinged plate 62 rigidly secured to pivot member 66 by connecting link 64. Hinged plate 62, preferably having a V shaped center portion 63, adapted to engage arm 52, preferably at edge surface 53, is secured in first side wall 74 of plate 70 for arm invoked hinge like movement from a raised position to a lowered position wherein it rests on edge 77 of second side wall 76 of plate 70.

Figure 5:
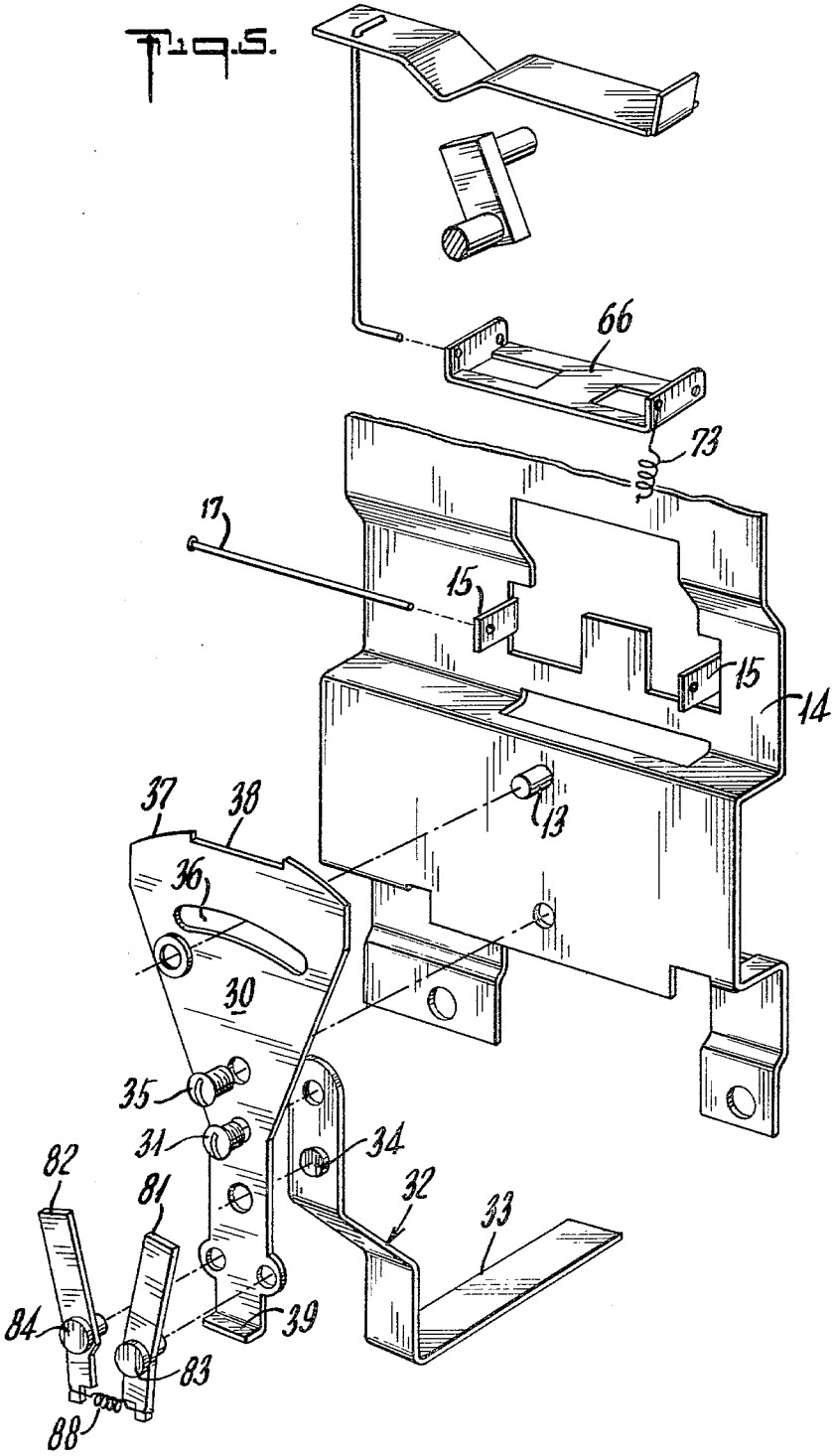
FIG. 5 is an exploded perspective view of the dispensing mechanism of FIG. 1 with the cam and linkage means removed.

As shown in FIG. 5, member 66, pivotally secured to integral brackets 15 of front wall 14 by pin 17, is biased downward towards engagement with plate 30 by spring 73 connected to wall 72 (shown in FIG. 3). Member 66 is of H-shaped configuration adapted to be received in notch 38 of plate 30, and when received therein, plate 30 is maintained in rest or locked position. Plate 30, pivotally secured to front wall 14 by fastener 35, includes arcuately shaped slot 36, curved surface 37 having notch 38 therein and stop position 39, and has secured thereto a pair of tumbler arms 81 and 82 and escrow bar 32. Escrow bar 32, rigidly secured to plate 30 by fastener 31 and stud 34, has a cantilevered portion 33 extending into the bin of a length slightly less than an axial length of a can to retain only front stack cans when the bar is in locked position. The pair of tumbler arms 81, 82 are pivotably mounted on plate 30 by pivots 83, 84, respectively and urged by spring 88 into engagement with stop portion 39 to limit their pivotal movement in that direction. Slot 36 is sized to receive stud 13 of front wall 14 so as to limit the pivotal movement of plate 30, to either a first position wherein the first support member 47 is maintained in its article support position by engaging tumbler arm 81 while second support member 48 is directed via linkage means 40 to its article release position, or a second position wherein the second support member 48 is maintained in its article support position by engaging tumbler arm 82 while the first support member 47 is directed via linkage means 40 to its article release position.

Referring to FIG. 6, support members 47, 48 secured at one end by their respective support link and limiting member have their other end in holes 17, 18, respectively, of rear wall 16 to permit linkage means 40 directed pivotal displacement of the support members from a raised position, where they touch a lower edge of the front wall and are in a plane slightly above their article support positions, to a lowered or article release position where the pair of limiting members 49 prevent further downward displacement of the support members.

With the apparatus in stand-by condition and prior to commencement of the first cycle of operation as shown in FIG. 2, arm 52 is positioned such that surface 53 and pin 54 are upward. Surface 53 is in engagement with portion 63 of plate 62 so that member 66 is lifted out of notch 38, unlocking latch plate 30 to permit its pivotal movement to either its first or second position. Pin 54 positions vertical link 42 upward, which via cross link 44 and support links 45, 46, positions support members 47, 48, respectively, in their article support position with both members supporting the load of cans in the bin.

Figure 7:
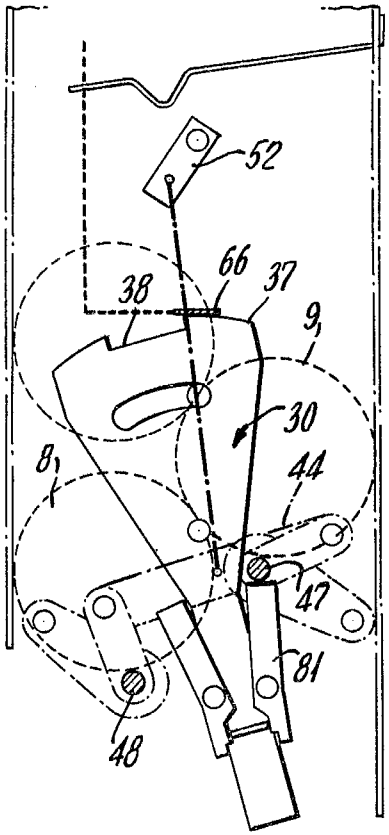

Activation of the control circuit energizes motor 20, which via switch 22, causes cam 24 and stem 50 to commence counterclockwise rotation so that pin 54 forces vertical link 42 downward exerting through cross link 44 and support links 45, 46 a movement producing force onto support members 47, 48, respectively. However, as shown in FIG. 7 where the operation of the apparatus commenced with the lowermost pair of axially aligned cans 8 in bin 10*c* supported on second support member 48, first support member 47 is maintained via engagement with tumbler arm 81 in its article support position, thereby supporting the load of cans above the axially aligned pair of cans 9, causing the movement producing force to be directed through cross link 44 and support link 46 to second support member 48 and with the aid of the weight of the pair of cans 8 pivoting the second support member towards its article release position. At the same time, the counterclockwise movement of arm 52 results in member 66 being lowered onto surface 37, but not into notch 38, of plate 30.

Figure 8:
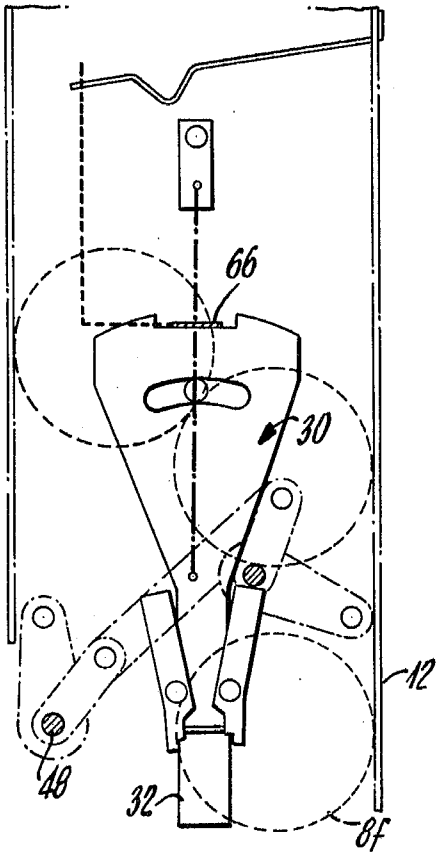

As shown in FIG. 8, second support member 48 has reached its article released position where two cans, one from each stack in a corresponding column, are released. The can from the rear stack was dispensed to the operator. The can from the front stack, represented by reference numeral 8*f*, struck escrow bar 32 causing plate 30 to pivot so that member 66 fell into notch 38, thereby retaining the plate and the escrow bar in locked position and can 8*f* between the escrow bar and side wall 12.

Thereafter, but prior to the return of second support member 48 to its article support position, one of the pair of surface cutouts 25, 26 reaches the contacts of arm 21 discontinuing their contact with surface 23, so that the control circuit and motor 20 are de-energized and the first cycle of operation is completed. Preferably, this de-energization occurs after arm 52 enters its upward rotation wherein support member 48 has started back towards its support position, so that a relatively short period of time will elapse between reactivation of the control circuit and dispensing of retained can 8*f*.

Re-energization of the control circuit and motor 20 causes re-initiation of rotation of cam 24 and stem 50, with arm 52 forcing vertical link 42 upwards pulling with it both support members 47 and 48. Before second support member 48 reaches its article support position, first support member 47 reaches its raised position wherein it is prevented from further upward movement by its contact with lower edge 4 of front wall 14 (shown in FIG. 1). As arm 52 continues to rotate upwards, the movement producing force coupled with first support member 47 being prevented from moving causes linkage means 40 to flex immediately so that in first support member 47 drops downward back into engagement with tumbler arm 81, second support member 48 rises into a plane above member 47, and the load of the cans shifts from the first to the second support member.

Figure 9:
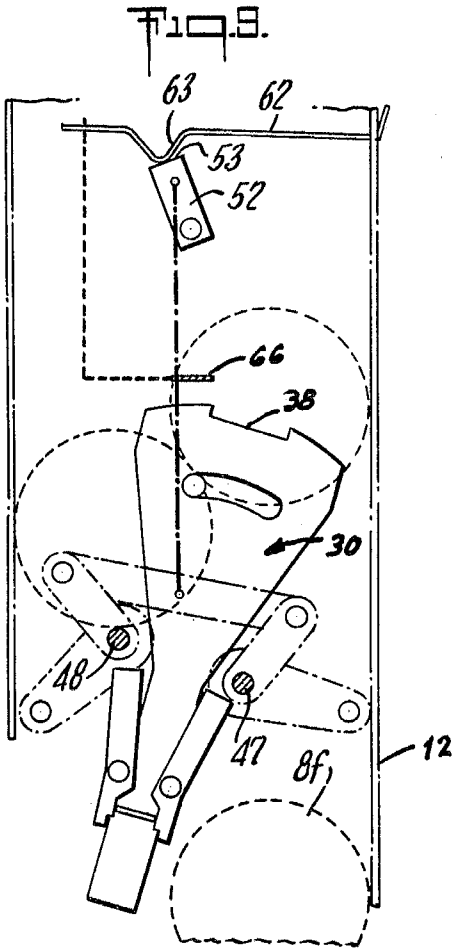
FIGS. 7 to 9 are front views of the dispensing mechanism as shown in FIG. 2 particularly illustrating the operation of the linkage means and latch plate.

Thereafter, as shown in FIG. 9, edge surface 53 of arm 52 contacts portion 63 of plate 62 so that the plate is swung upward lifting connected member 66 out of notch 38, unlocking latch plate 30 and escrow bar 32. The force of first support member 47 on tumbler arm 81 causes latch plate 30 and the escrow bar to pivot away from side wall 12 so that can 8*f* is dispensed. Thereafter the other one of the pair of surface contacts 25, 26 reaches the contacts of arm 21, de-energizing motor 20 and the control circuit and completing the second cycle of operation.

FIGS. 7–9 show the embodiment where the lowermost cans in bin 10*c* were supported initially on second support member 48. If the cans were initially supported instead on first support member 47, second support member 48 would be maintained via engagement with tumbler arm 82 while first support member 47 would move analogous to the movements described above for member 48. Also, latch plate 30 would pivot opposite to the positions shown in FIGS. 7 and 9. In any event after every two cycle operation, the support members alternate support and movement roles.

Figure 10:
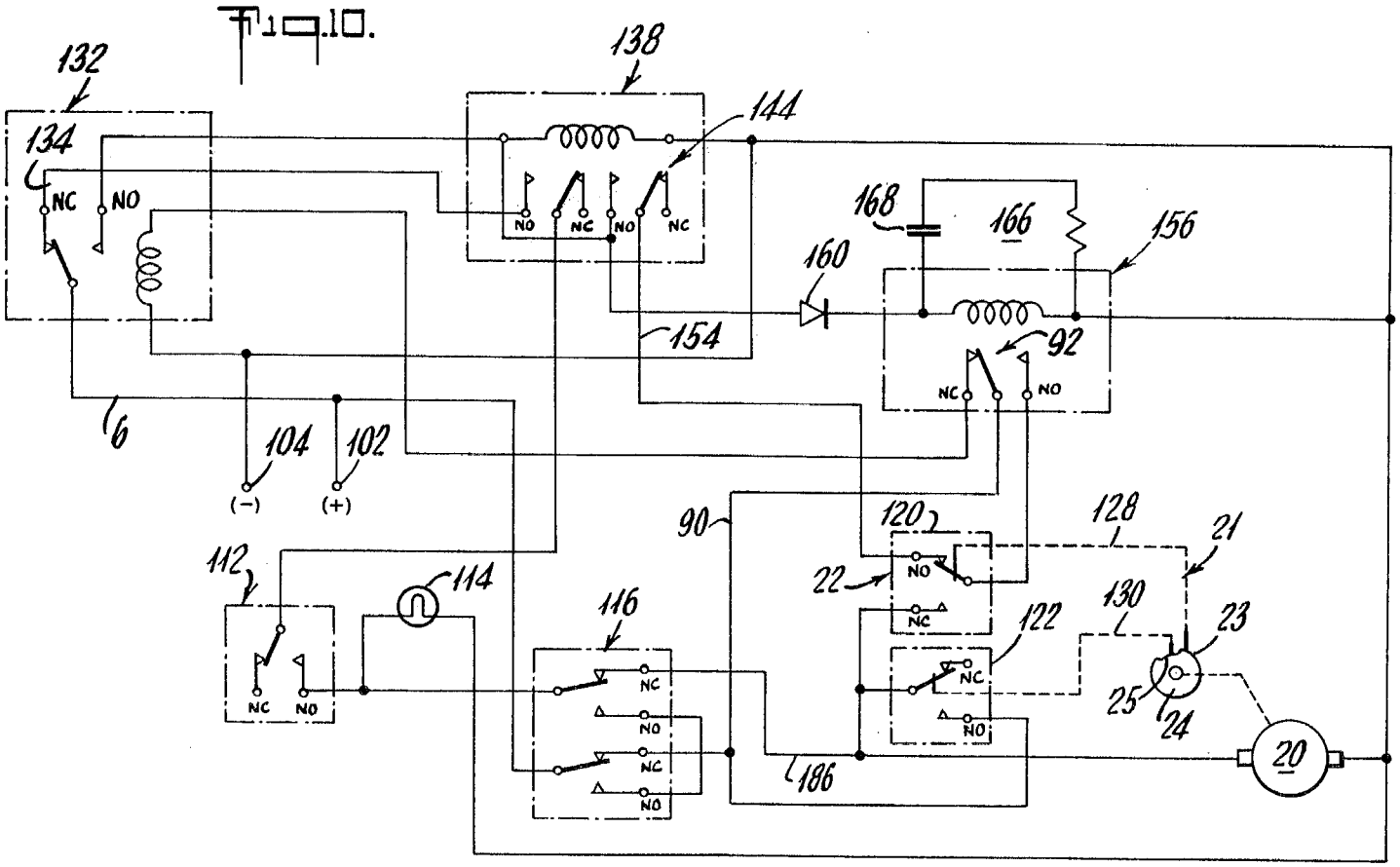
FIG. 10 is a schematic diagram of the circuit for energizing the single dispensing mechanism shown in FIG. 1.

The control circuit shown in FIG. 10 is a simplification of the circuit disclosed in commonly-assigned patent application Ser. No. 12,865 filed Feb. 16, 1979, now U.S. Pat. No. 4,220,235 incorporated herein by reference. The circuit, simplified to show only bin 10*c* circuitry and a single cutout 25 on cam 24 is energized by conventional supply source (not shown) connected to positive (+) terminal 102 and negative (−) terminal 104. Associated solely with bin 10*c* is motor 20, switch 22 which includes credit release switch 120 and timer switch 122, pair of sold-out switches 116, sold-out conductor light 114, and selector switch 112. Control circuit components common to all bins include coin-operated mechanism 132, vend relay 138 and credit release relay 156 with associated time delay means 166.

Cam 24 is connected to credit release switch 120 and timer switch 122 via contacts 128 and 130, respectively, of arm 21. With the apparatus in stand-by condition and prior to commencement of the first cycle of operation, contact 128 is on surface 23 and contact 130 is in cutout 25 so that credit release switch 120 is in its first, normally-open (NO) position and timer switch 122 is in its first, normally-closed (NC) position. When motor 20 is energized by operation of selector switch 112, cam 24 commences rotation (clockwise in this Figure). Contact 128 immediately enters cutout 25 so that credit release switch 120 switches to its second, normally-closed (NC) position. As cam 24 continues to rotate, surface 23 reaches contact 130 so that timer switch 122 switches to its second, normally-open (NO) position, then contact 128 reaches surface 23 so that credit release switch 120 returns to its first position, until contact 130 re-enters cutout 25 so that timer switch 122 returns to its first position, terminating the first cycle of operation.

Upon insertion of the proper coinage into supply source connected mechanism 132, coin switch 134 therein is momentarily actuated and vend relay 138 through conductor 146 is momentarily energized, with power additionally supplied through diode 160 to energize credit release relay 156. A vend relay holding circuit is established from "hot" line 6, through sold out switches 116, through line 90, through the now-closed normally-open (NO) contact 92 of credit release relay 156, through connected credit release switch 120, through line 154, and then through the now-closed normally-open (NO) contact 144 of vend relay 138. Time delay means 166 maintains the energization of relay 156, after relay 138 is de-energized, for a predetermined time interval long enough for timer switch 122 to switch to its second position where it energizes motor 20 but short enough so that credit release relay 156 is de-energized before a vend motor, corresponding to any other bin is energized. Upon customer activation of selector switch 112 and with sold out switches 116 in their normally closed (NC) position, a direct energization path 186 is established to motor 20 so that cam 24 begins rotation and credit release switch 120 almost immediately switches to its second position where it interrupts and immediately de-energizes vend relay 138 so as to remove power from selector switch 112, while credit release relay 156 remains energized due to time delay means 166. As cam 24 rotates, timer switch 122 switches to its second position establishing a direct energization path for motor 20 of sufficient power to rotate cam 24 all the way around until timer switch 122 returns to its first position where motor 20 is de-energized. Meanwhile, time delay means 166 de-energizes through its capacitor 168 credit release relay 156, removing power from credit release switch 120 so that established credit is removed and the circuit is prepared to receive the next insertion of coinage.

Although a certain embodiment has been described and illustrated, modification may be made herein, as by adding, combining or subdividing parts or by substituting equivalents or by applying the invention to other types of valves or mechanisms while retaining advantages and benefits of the invention, which itself is defined in the following claim.

I claim:

1. Apparatus for dispensing a single article at a time from at least two adjacent staggered stacks of articles in a bin with corresponding articles in the stack being axially aligned of each other, said apparatus comprising:

(a) a selectively energizable motor;

(b) a cam energizably engageable with said motor, said cam having a surface with a pair of surface cutouts therein;

(c) a stem secured to said cam and rotatable therewith, said stem having an arm with a pin thereon;

(d) switch means disposed to be engaged by the surface of said cam and responsive thereto, wherein energization of said motor is interrupted when either of the pair of surface cutouts is reached by said switch means;

(e) first and second support members disposed in the bin and mounted for movement from an article support position wherein the lowermost articles of the stacks are engaged and supported, to an article release position wherein an article from each stack is released for dispensement;

(f) linkage means including (1) a vertical link secured to and directed for movement by the pin, (2) a cross link pivotally secured at its centermost portion to said vertical link, (3) a pair of support links, one of said pair of support links being pivotally secured to said cross link at one end thereof and said first support member, the other of said pair of support links being pivotally secured to said cross link at the other end thereof and said second support member, so that pin directed movement of said vertical link results in movement producing force being applied through said cross link and said pair of support links to said first and second support members, (g) a latch plate pivotably mounted for movement from a rest position wherein said latch plate engages and holds said first and second support members in their article support position, to either a first position wherein said latch plate engages said first support member to prevent its movement to its article release position, or a second position wherein said latch plate engages said second support member to prevent its movement to its article release position;

(h) releasable lock means adapted to be engaged by the arm for disposition from a locked position wherein said latch plate is retained in rest position to an unlocked position wherein said latch plate is disposed to either its first or second position;

(i) an escrow bar rigidly secured to said latch plate and pivotal therewith from a rest position where it retains one of the two articles released by one of said first and second support members, to a release position;

(j) control means for selectively operating said motor including means for initiating energization of said motor to rotatably drive said cam and said stem, whereby the pin directed linkage means transmits a movement producing force on said first and second support members while the arm engages said lock means for disposition to its unlocked position wherein said latch plate pivots to either its first or second position overcoming the movement producing force and maintaining one of said support members in its article support position while the other of said support members is directed to its article release position whereupon said latch plate and said escrow bar enter their locked position and the other of said support members releases a pair of cans, with one dispensed to the operator and the other retained by said escrow bar and thereafter one of the pair of surface cutouts reaches said switch means de-energizing said motor and said control means and terminating rotation of said cam and said stem, said initiating means initiated a second time energizing said motor and continuing rotation of said cam and said stem to dispose said escrow bar to its unlocked position whereby dispensing the retained can, and upon reaching the second of the pair of surface cutouts de-energizing said motor and said control means and terminating rotation of said cam and said stem.

* * * * *